US006508731B1

(12) United States Patent
Feeney et al.

(10) Patent No.: US 6,508,731 B1
(45) **Date of Patent: *Jan. 21, 2003**

(54) COMPOSITE BAT WITH METAL BARREL AREA AND METHOD OF FABRICATION

(75) Inventors: Brian P. Feeney, East Windsor, CT (US); Thomas J. Kennedy, III, Wilbraham, MA (US)

(73) Assignee: Spalding Sports Worldwide, Inc., Chicopee, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/563,607

(22) Filed: May 2, 2000

Related U.S. Application Data

(63) Continuation of application No. 09/019,998, filed on Feb. 6, 1998, now Pat. No. 6,056,655, which is a continuation-in-part of application No. 08/948,445, filed on Apr. 16, 1998, which is a continuation of application No. 08/669,072, filed on Jun. 24, 1996, now abandoned, which is a continuation-in-part of application No. 08/595,535, filed on Feb. 2, 1996, now Pat. No. 5,722,908.

(51) Int. Cl.[7] ..... A63B 59/06
(52) U.S. Cl. ..... 473/567; 473/566

(58) Field of Search ..... 473/564–568, 473/457

(56) References Cited

U.S. PATENT DOCUMENTS 5,722,908 A * 3/1998 Feeney et al. ..... 473/567
6,056,655 A * 5/2000 Feeney et al. ..... 473/6

FOREIGN PATENT DOCUMENTS

JP 406091026 * 4/1994

* cited by examiner

*Primary Examiner*—Mark S. Graham

(57) ABSTRACT

A ball bat comprising a bat frame in a generally cylindrical configuration. The bat has an essentially cylindrical hitting area and a handle area remote from the hitting area and with a tapering transition zone therebetween. The bat frame is fabricated of a composite material of fibers in a matrix binder. A cylindrical recess is formed in the hitting area and has an annular inner face and parallel end faces at the ends of the recess. An annular insert metal with an interior cylindrical surface is in contact with the inner face of the recess and with parallel end faces in contact with the end faces of the recess and a cylindrical exterior surface essentially flush with the portions of the bat frame on opposite sides of the recess.

13 Claims, 10 Drawing Sheets

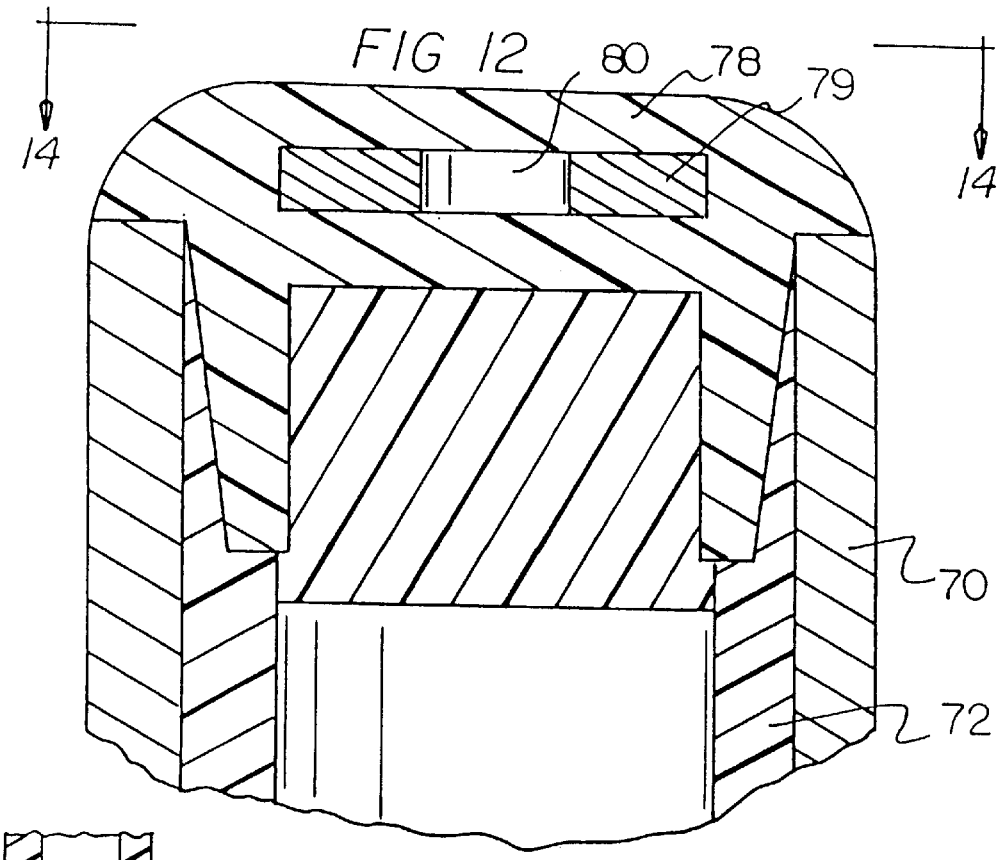
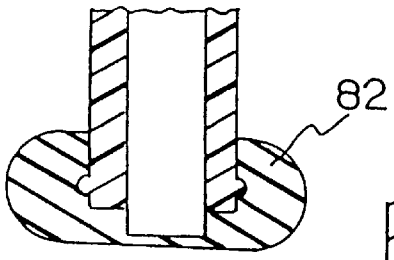
FIG 13A
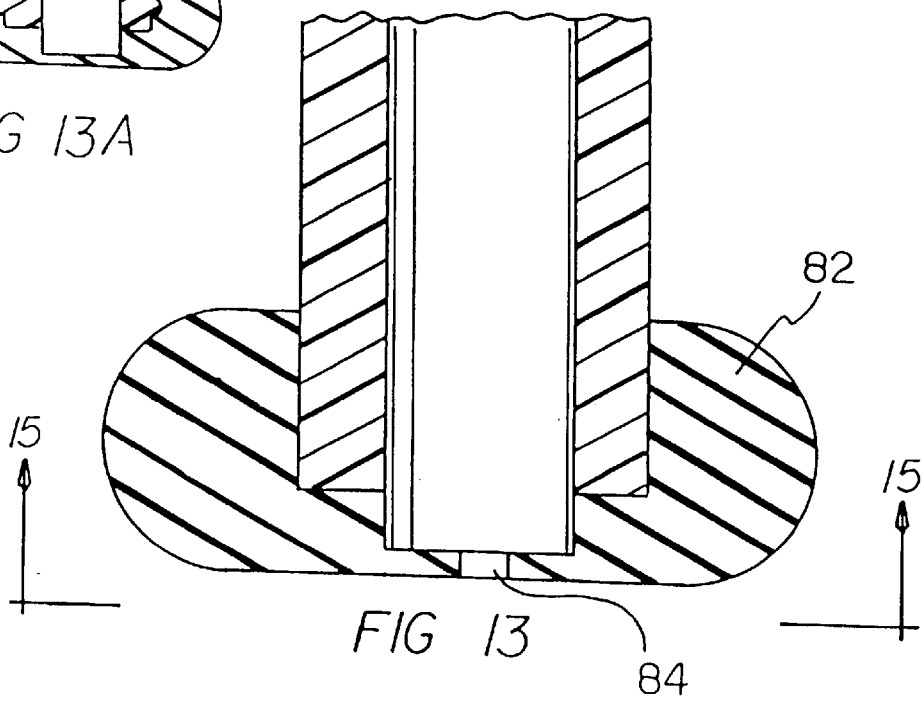
FIG 13

FIG 14
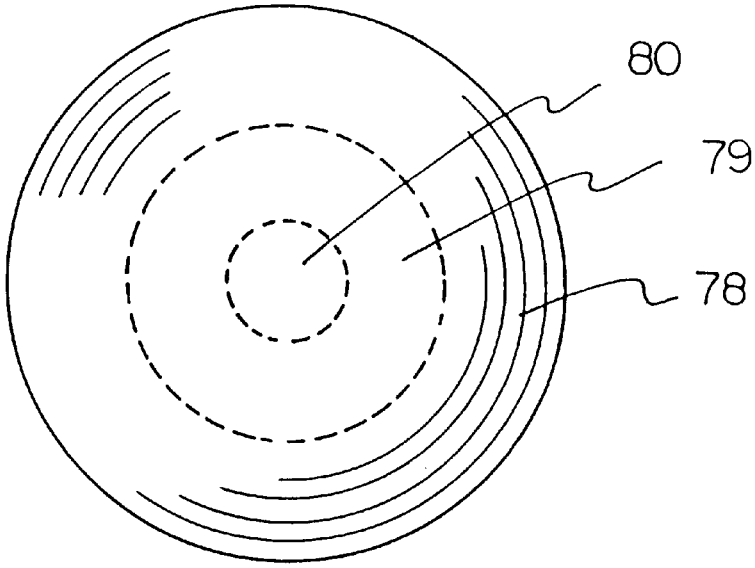
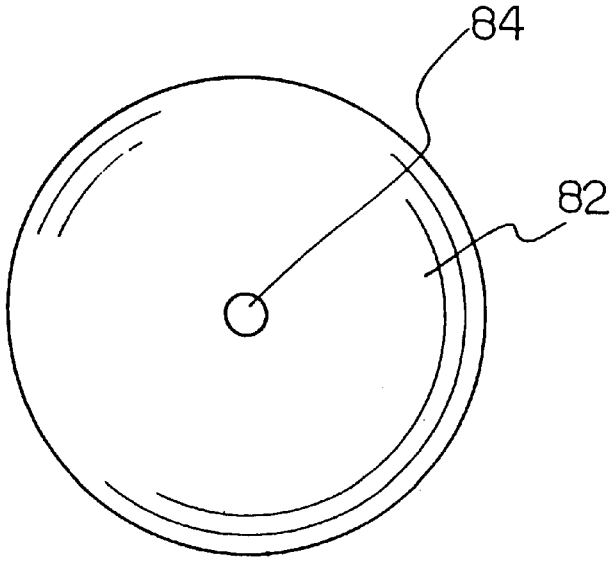
FIG 15

COMPOSITE BAT WITH METAL BARREL AREA AND METHOD OF FABRICATION

RELATED APPLICATION

This application is a Continuation of U.S. application Ser. No. 09/019,998 filed Feb. 6, 1995 U.S. Pat. No. 6,056,655, which is a Continuation-in-Part of U.S. application Ser. No. 08/948,445, filed Apr. 16, 1998, pending which is a Continuation of U.S. application Ser. No. 08/669,072, filed Jun. 24, 1996, abandoned, which is a Continuation-in-Part of U.S. application Ser. No. 08/595,535, filed Feb. 2, 1996, U.S. Pat. No. 5,722,908.

BACKGROUND OF THE INVENTION

1. Field of the Invention

The present invention relates to composite bat with metal barrel area and fabrication method and more particularly pertains to improving ball bat performance in terms of liveliness, shock and vibration dampening as well as weight distribution.

2. Description of the Prior Art

Baseball, softball and other bats of various designs and configurations are known in the prior art. Such bats heretofore devised and utilized for the purpose of improving the playing characteristics of ball bats through various methods and apparatuses are known to consist basically of familiar, expected and obvious structural configurations, notwithstanding the myriad of designs encompassed by the prior art which have been developed for the fulfillment of countless objectives.

By way of example, the prior art in U.S. Pat. No. 4,505,479 to Souders discloses a weighted bat with a weight securing means. U.S. Pat. No. 5,104,123 to Ikitsu discloses a metal bat for use in baseball. U.S. Pat. No. 5,301,940 to Seki discloses a baseball bat and production thereof. U.S. Pat. No. 5,303,917 to Ute discloses a bat for baseball or softball. U.S. Pat. No. 5,364,095 to Easton discloses a tubular metal ball bat internally reinforced with a fiber composite. U.S. Pat. No. 5,393,055 to MacKay discloses a ball bat with concentrated weight load and method of making the same. U.S. Pat. No. 5,395,108 to Souders discloses a simulated wood composite ball bat. U.S. Pat. No. 5,460,469 to Baum discloses a composite baseball bat. U.S. Pat. No. 3,972,528 to McCracken discloses a baseball bat grip. Japanese Patent Number 406091026A to Higuch discloses a bat and method of forming thereof. Lastly, Japanese Patent Number 52-15736 to Tanikawa and U.S. Pat. No. 4,025,377 to Tanikawa disclose a method of producing a baseball bat.

In this respect, the composite bat with metal barrel area and method of fabrication according to the present invention substantially departs from the conventional concepts and designs of the prior art, and in so doing provides an apparatus primarily developed for the purpose of improving performance in terms of liveliness, shock and vibration dampening as well as weight distribution.

Therefore, it can be appreciated that there exists a continuing need for new and improved composite bat with metal barrel area and method of fabrication which can be used for improving performance in terms of liveliness, shock and vibration dampening as well as weight distribution. In this regard, the present invention substantially fulfills this need.

SUMMARY OF THE INVENTION

In view of the foregoing disadvantages inherent in the known types of baseball, softball and other bats of various designs and configurations now present in the prior art, the present invention provides an improved composite bat with metal barrel area and method of fabrication. As such, the general purpose of the present invention, which will be described subsequently in greater detail, is to provide a new and improved composite bat with metal barrel area and method of fabrication which has all the advantages of the prior art and none of the disadvantages.

To attain this, the present invention essentially comprises a bat frame in a generally cylindrical configuration. The bat frame has an essentially cylindrical hitting area. The hitting area terminates in a generally spherical closed end and has a handle area remote from the hitting area terminating in a short radially enlarged knob and with a tapering transition zone intermediate the hitting area and the handle area. The bat frame is preferably fabricated of a composite material of linearly aligned fibers in a matrix binder. A recess is formed in the hitting area. The recess is in a cylindrical configuration and has an annular inner face. It also has parallel end faces at the ends of the recess and an opened annular exterior. An annular insert is provided. The insert is preferably fabricated of aluminum with an interior generally cylindrical surface in contact with the inner face of the recess and with radially extending parallel end faces in contact with the end faces of the recess and further has a cylindrical exterior surface essentially flush with the portions of the bat frame on opposite sides of the recess to form a continuous exterior surface on the hitting end of the bat.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved composite bat with metal barrel area and method of fabrication which has all the advantages of the prior art baseball, softball and other bats of various designs and configurations and none of the disadvantages.

It is another object of the present invention to provide a new and improved composite bat with metal barrel area and method of fabrication which may be easily and efficiently manufactured.

It is a further object of the present invention to provide a new and improved composite bat with metal barrel area and method of fabrication which is of a durable and reliable construction.

An even further object of the present invention is to provide a new and improved composite bat with metal barrel area and method of fabrication which is susceptible of a low cost of manufacture with regard to both materials and labor.

Still another object of the present invention is to improve the performance of bats in terms of liveliness, shock and vibration dampening as well as weight distribution.

Lastly, it is an object of the present invention to provide a new and improved ball bat comprising a bat frame in a generally cylindrical configuration. The bat has an essentially cylindrical hitting area and a handle area remote from the hitting area and with a tapering transition zone therebetween. The bat frame is fabricated of a composite material of fibers in a matrix binder. A cylindrical recess is formed in the hitting area and has an annular inner face and parallel end faces at the ends of the recess. An annular insert metal with an interior cylindrical surface is in contact with the inner face of the recess and with parallel end faces in contact with the end faces of the recess and a generally cylindrical exterior surface essentially flush with the portions of the bat frame on opposite sides of the recess.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 showing an embodiment of the invention where a layer of sixty (60) degree plies is being wrapper around the bat; FIG. 3A showing an embodiment where a full length ply has fibers oriented at zero (0) degrees with four of these types of plies wrapped half way around the core or greater forming two layers of material which are used to start the bat lay-up; FIG. 3B showing an embodiment with the lay-up at a much later stage with all of the 0 degree plies down and the drop offs clearly visible in the transition area and with a 90 degree ply shown in the barrel area.

FIG. 10 is a view showing a partial layer of woven fabric applied to the composite material.

FIG. 12 is a cross-sectional view of the bat with an end cap installed, the weighted metal disk being visible within the end cap along with a cast in place urethane used to adjust the final weight of the bat taken at the upper circle of FIG. 9.

FIG. 13 is a cross-sectional view of a the handle end of the bat with a knob taken at the lower circle of FIG. 9.

FIG. 13A is a cross-sectional view of an alternate embodiment where a mechanical lock between the bat handle end and the knob is employed.

FIGS. 14 and 15 are elevational views of the bat end and handle knob respectively of the bat of FIG. 9.

Similar reference characters refer to similar parts throughout the several views of the drawings.

DESCRIPTION OF THE PREFERRED EMBODIMENT

Figure 1:
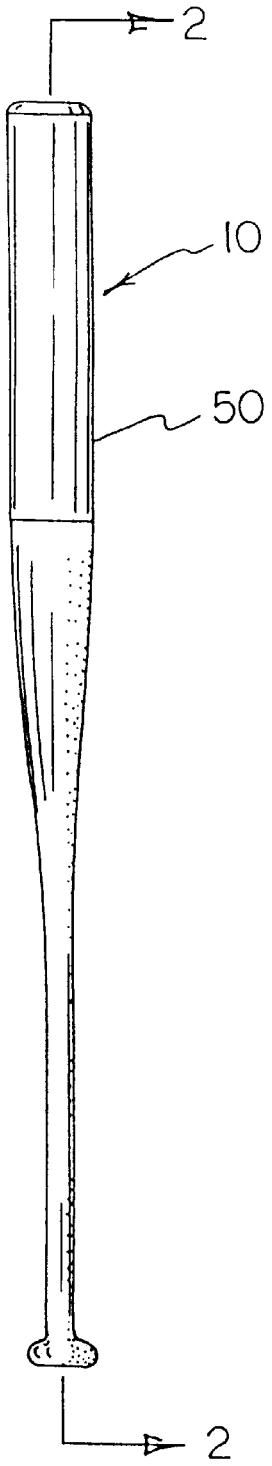
FIG. 1 is a perspective illustration of the preferred embodiment of the composite bat with metal barrel area constructed in accordance with the principles of the present invention.
Figure 2:
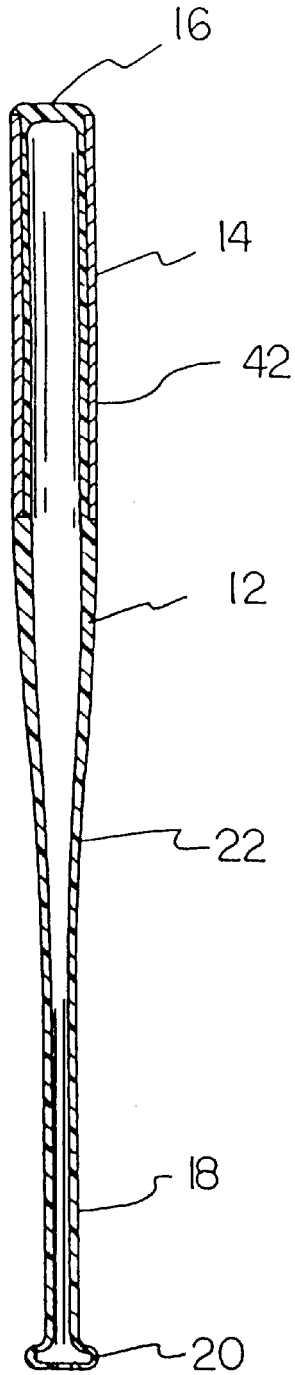
FIG. 2 is a cross-sectional view of the bat in accordance with the primary embodiment of the invention taken along line 2—2 of FIG. 1.

With reference now to the drawings, and in particular to FIG. 1 thereof, a new and improved composite bat with metal barrel area and method of fabrication embodying the principles and concepts of the present invention and generally designated by the reference numeral 10 will be described.

The present invention, the new and improved composite bat with metal barrel area is comprised of a plurality of components. Such components in their broadest context include a bat frame, a recess and an annular insert. Such components are individually configured and correlated with respect to each other so as to attain the desired objective.

The present invention is a system 10. The system 10 includes a bat frame 12 in a generally cylindrical configuration. The bat frame has an essentially cylindrical hitting area 14. The hitting area terminates in a generally spherical closed end 16. The frame also has a handle area 18 remote from the hitting area which terminates in a short radially enlarged knob 20. A tapering transition zone 22 is located intermediate the hitting area and the handle area. The bat frame is preferably fabricated of a composite material 24 of linearly aligned fibers 26 in a matrix binder 28.

A recess 32 is formed in the frame within the hitting area. The recess is in a cylindrical configuration and has an annular inner face 34. It also has parallel end faces 36 at the ends of the recess and an opened annular exterior 38.

An annular insert 42 is provided as a principal component of the system. The insert is preferably fabricated of aluminum 44 with a generally interior cylindrical surface 46 in contact with the inner face of the recess. The insert also has radially extending parallel end faces 48 in contact with the end faces of the recess. The insert further has a cylindrical exterior surface 50 essentially flush with the portions of the frame on opposite sides of the recess to form a continuous exterior surface on the hitting end of the bat. The insert is a cylinder with an axial length. The barrel or hitting area may include a partially tapered area. Such axial length is in excess of 75 percent of the axial length of the cylindrical hitting area between the closed end of the bat frame and the tapering transition zone, preferably 100 percent.

The present invention further includes a method of fabricating a bat 10 as described above. The method of fabricating a bat is comprised of the steps of providing a bat frame 12 in a generally cylindrical configuration. The bat frame has an essentially cylindrical hitting area 14 terminating in a generally spherical closed end 16 and a handle area 18 remote from the hitting area terminating in a short radially enlarged knob 20 and with a tapering transition zone 22 intermediate the hitting area and the handle area. The bat frame is preferably fabricated of a composite material 24 of linearly aligned fibers 26 in a matrix binder 28.

Next is the step of providing an annular insert 42. The insert is preferably fabricated of aluminum with an interior generally cylindrical surface 46 and with radially extending parallel end faces 48 and a cylindrical exterior surface 50.

Next is the step of positioning the insert around the frame in the hitting area. The frame and insert are then positioned into a mold 54 formed of two halves which has an internal configuration 56 when closed to correspond to the exterior configuration of the bat to be fabricated.

Heat is applied by the mold. Pressure is applied to a bladder 64 within the composite frame in the conventional manner. The heat and pressure are sufficient whereby a recess 32 is formed in the hitting area. The recess is in a cylindrical configuration and has an annular inner face 34 in contact with the interior face of the insert. Parallel end faces 36 are provided at the ends of the recess in contact with the ends of the insert and an opened annular exterior of the recess is located essentially coextensive with the exterior surface of the insert. The heat and pressure also are sufficient to cure the composite materials of the frame.

The bat frame and insert are then removed from the mold to thereby provide a unitary ball bat with an aluminum insert in the hitting area.

The goal of the present invention is to produce a bat with superior performance to current bats. The invention and discussion will focus primarily on softball bats, but the same basic concept could be used to produce baseball bats. The performance advantage can be defined in terms of three basic areas, for example, liveliness, shock and vibration dampening, and weight distribution of the bat. This invention is capable of producing a bat that is lower in cost with similar or superior performance to bats available on the market today.

As previously discussed, the bat consists of composite layers with a metal tube added to the outside area of the barrel or hitting area. The easiest method to produce such a bat is by utilizing an internal bladder compression molding technique. In this process a two piece female mold is manufactured with the desired length and shape. The mold may or may not incorporate an end cap portion of the bat.

In an alternate embodiment, these items are manufactured from a variety of materials by many methods including, but not limited to, compression molding and injection molding. These items are later adhesively or mechanically attached to the frame of the bat in an assembly process.

The female compression mold is designed such that a pressure fitting, bolts 58 in threaded apertures 60, is attached at either end of the bat and that the opposite end is closed or is readily sealed to retain molding pressures. The bolts 58 are optional and are not necessary if a platen press is used. Note at the parting line of one end of the mold a pair of apertures are formed as channels for excess resin. In addition, located therebetween is an open end of a bladder for pressurizing the bladder during the molding. A mandrel or core 62 to assist in the creation of the composite component of the bat is produced with a contour that is similar to female mold just described, but which has smaller dimensions that the female mold. FIGS. 3 through 6 show the mold and mandrel used to manufacture the initial prototypes.

To produce the bat, a bladder 64 consisting of either a removable rubber bladder or a thin NYLON tubing that is retained in the finished product, is placed over the mandrel. Layers of composite material are then placed over the length of the mandrel. When sufficient material is placed over the mandrel and bladder, they are both removed from the mandrel. The barrel end of the composite material is positioned within a metal tube that will become part of the bat and the entire lay-up is positioned within the two-piece female mold. Pressure and heat are applied as required during the curing of the composite material and the finished bat is later removed from the mold. This method allows for the properties of the bat to be tailored to provide optimum properties. Alternative manufacturing methods including resin transfer molding, matched die compression molding and injection molding could also be utilized for possible advantages in manufacturing cost. Lastly, the shell could be molded separately and then the tube could be bonded over the composite shell with an adhesive.

The composite material consists of matrix and reinforcing fibers. The matrix in the preferred embodiment would consist of a toughened epoxy. Alternatives include any commonly used thermoset resin including vinyl ester, polyester, or the like. Thermoplastic resins such as NYLON could also be utilized. Many reinforcing fibers can be used either independently, or in conjunction with one another, including graphite, fiberglass, aramid, and Spectra. Two methods for producing the composite lay-up are most likely. One would be to wind a strip of composite material or cut and hand lay-up individual pieces of prepreg over the mandrel. An alternative would be to wet filament wind, the composite material, over the mandrel. Braided composite material combined with resin transfer molding is a further alternative.

Figure 3:
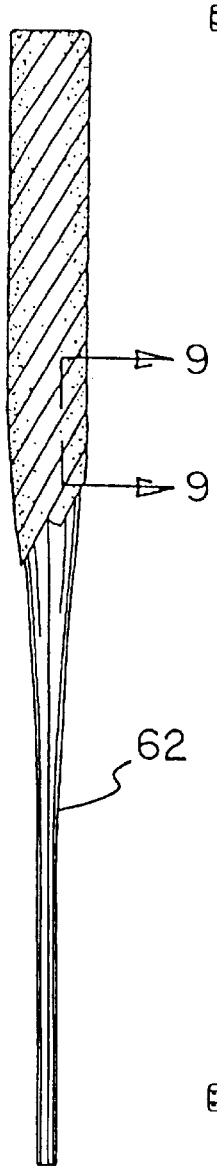
FIGS. 3, 3A and 3B as well as FIG. 10 are illustrations of different composite lay-ups of bats taken at various stages of fabrication.
Figure 4:
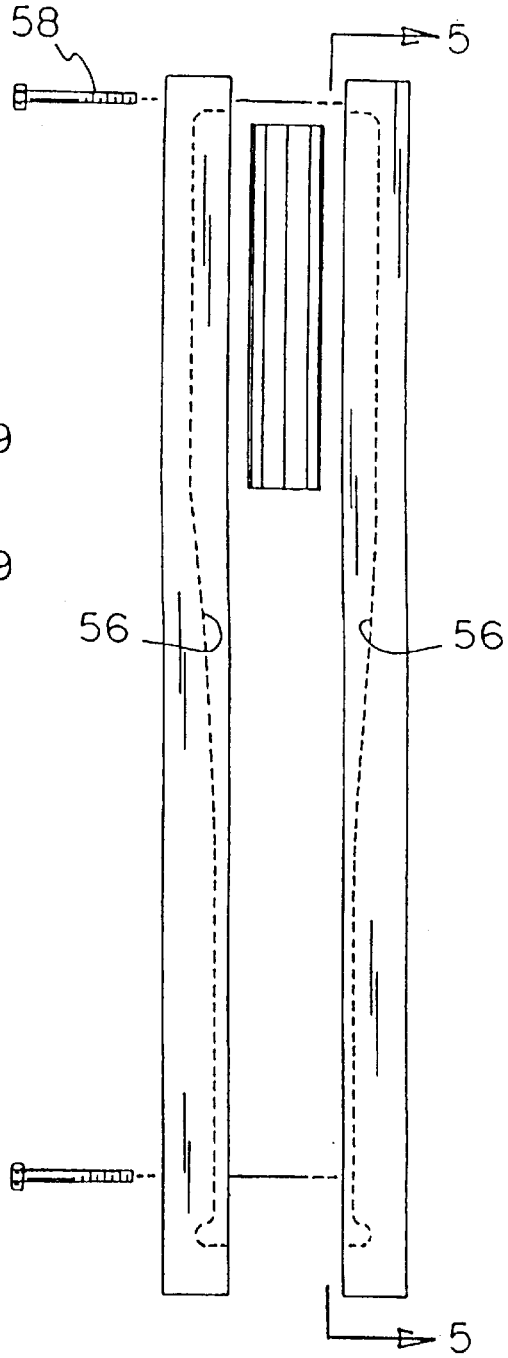
FIG. 4 is an exploded showing of the mold halves, metal insert and coupling components.
Figure 5:
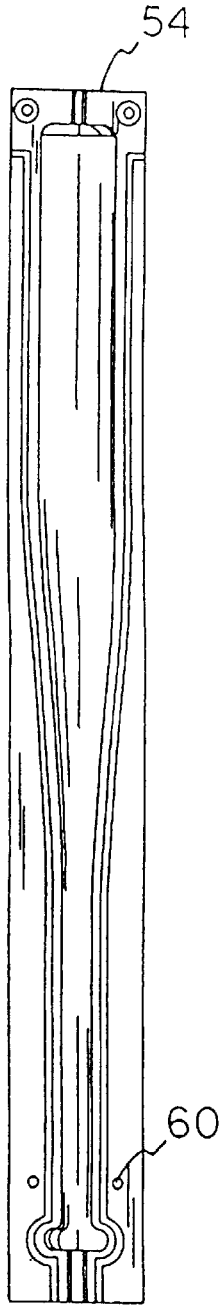
FIG. 5 is a top view of half of the mold taken along line 5—5 of FIG. 4.
Figure 3A:
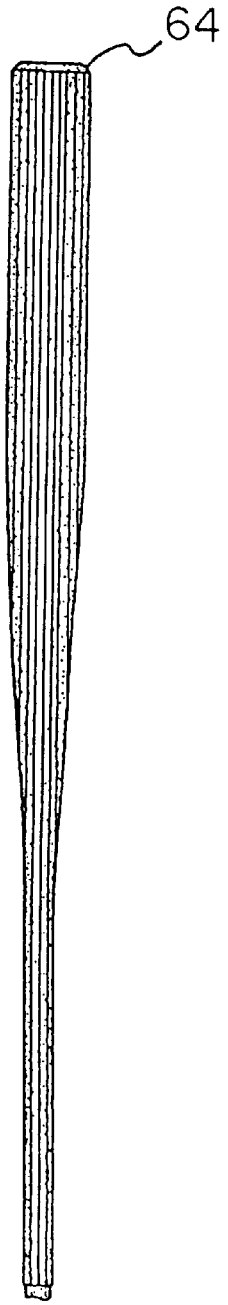
Figure 3B:
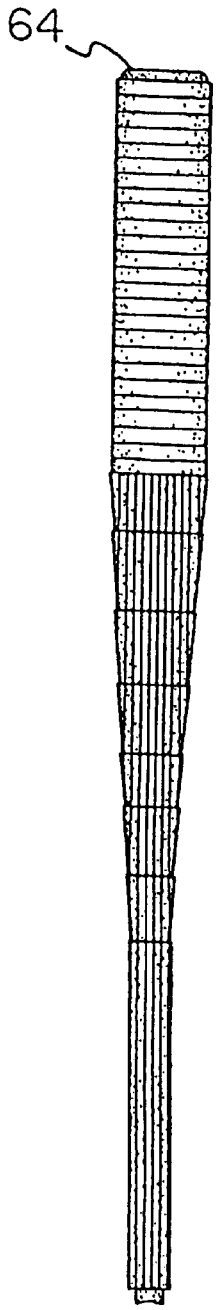
Figure 6:
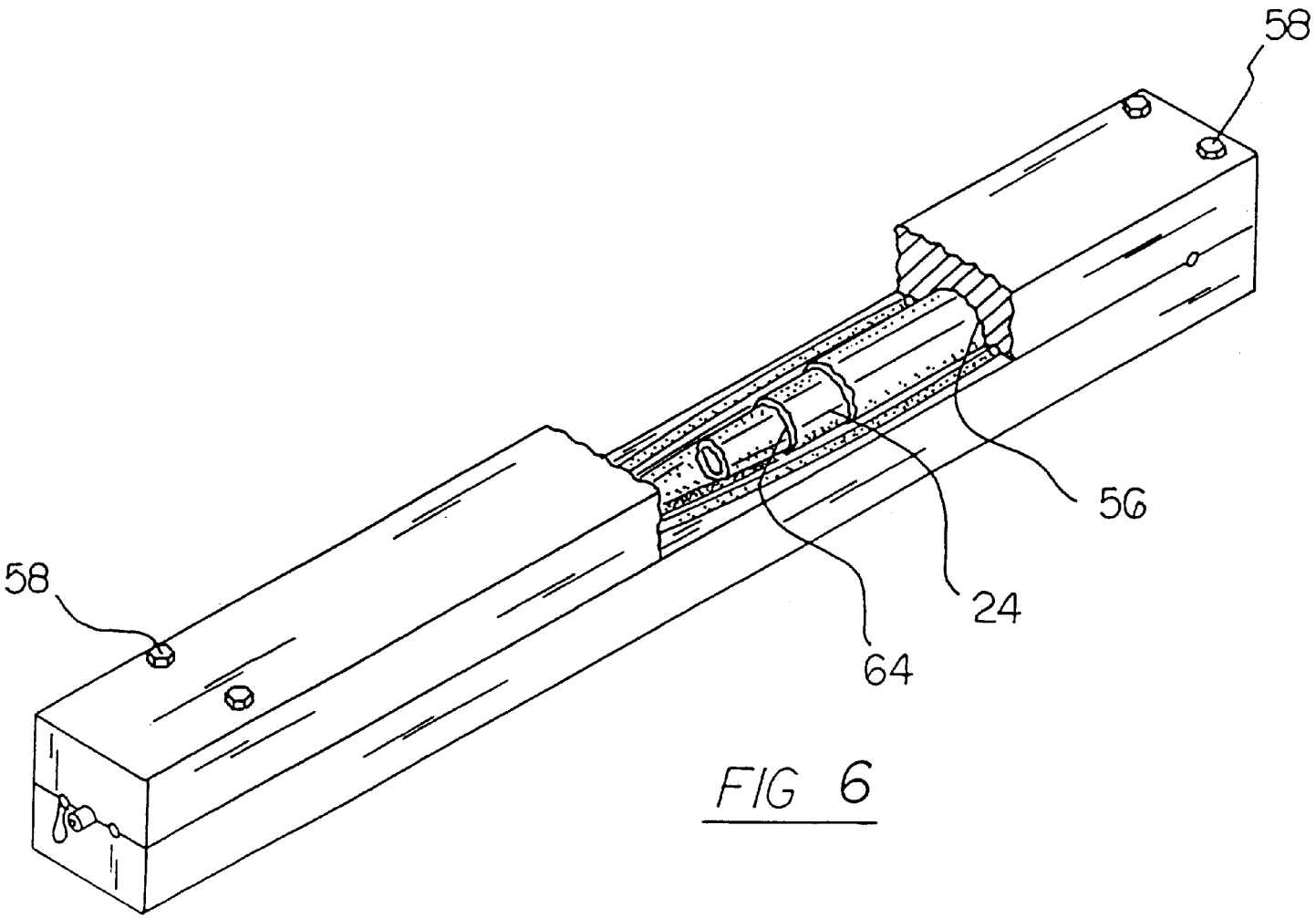
FIG. 6 is a perspective illustration of the bat during the molding process with parts broken away to show certain internal constructions thereof.

FIG. 3 shows the wrapping of tape over the hitting area of the core during the fabrication process. The linear aligned fibers of the wound tape are at about sixty (60) degrees from the axis of the bat. FIG. 3A illustrate composite material with the fibers at zero (0) degrees, essentially parallel with the axis of the bat. Shown in FIG. 3A is a half-ply. Two such half plies are applied to the core to cover its periphery an overlap of ⅛ to ¼ is acceptable. Four such half-plies are preferably utilized for a double layer over the entire core. FIG. 1B illustrates ninety (90) degree plies over the core. Thereafter, supplemental plies similar to those of FIGS. 3 and 3A are preferably utilized. Such supplemental plies are progressively shorter in the hitting area. As a result, 10 to 16 layers of 0 degree composite material are in the handle area. Thereafter 60 degree ply material may then be applied over the 0 degree ply in the hitting area and other areas as desired.

Many materials can be used in the metal tube portion of the bat. The choice of material would depend on the goal for this component. Aluminum is the preferred material and provides a relatively low cost material. Because aluminum has been the primary material of choice in softball bats, both players and manufacturers are familiar with the performance and design variables of aluminum alloys. The most likely candidates for aluminum alloys would be Alcoa CU-31 and C405, which fall in the general category of high performance 7000 series alloy. For increased performance and/or reduced weight, more exotic metal alloys could be utilized including steel, titanium alloys, nickel alloys, or metal matrix composite alloys. Each material offer different physical properties that may benefit performance of the bat at a typically higher cost than aluminum. Logically, the length of the metal tube would be limited to the essentially constant diameter portion of the barrel area of the bat. This alloy the metal tube to be formed in a low cost manner, either by extruding or rolling and seam welding, and eliminates the need for additional expensive forming operations. If desired, the metal tube could be formed and incorporated into a bat within the scope of the invention that extends down as far as the start of the handle of the bat.

The thickness and directional strengths of a composite bat can be easily controlled during he manufacturing process by using a specific amount of material and by orienting the reinforcement fibers in a particular direction. This anisotropic nature of composite materials is superior to the isotropic properties of metal alloys. The isotropic nature of metal alloys results in bats that may be designed and are heavier than required.

In current bats the methods utilized to form these bats result in wall thicknesses that are controlled by the wall thickness selected for the barrel end of the bat. Basically, as the bat is swaged the diameter of the bat is reduced from the barrel diameter down to the handle diameter. Since approximately the same amount of material is found in any cross section of the bat, the wall thickness increases as the diameter decreases. This results in a bat that is over designed in the transition and the handle areas of the bat, where they tend to be thicker than required. The amount of composite material and resultant wall thickness at any point along the bat is easily controlled and adjusted as desired. Utilization of composite materials can then result in a weight savings in the bat.

By saving weight in the shell of a bat, the overall weight of the bat is reduced. A bat with the same swing weight, but a lower overall weight can be produced by end loading or filling the end of the bat with a dense material, typically a castable urethane. A lighter bat with the same wing weight can be swung quicker and therefore provide additional energy at impact with the ball.

Composite material is also superior to metal materials in terms of shock absorption and vibration dampening. Specific matrix materials and reinforcement fibers offer the best shock and vibration dampening properties, specifically NYLON resins and Spectra fibers.

The choice of composite materials, metal alloy and manufacturing method depends on the desired properties of the end product. By varying the materials, the durability, the beam stiffness, the barrel, or hoop stiffness and ultimately the performance of the bat can be tailed to meet the demands of the market. The selection of materials and manufacturing methods also effect the end cost of the product.

Figure 1A:
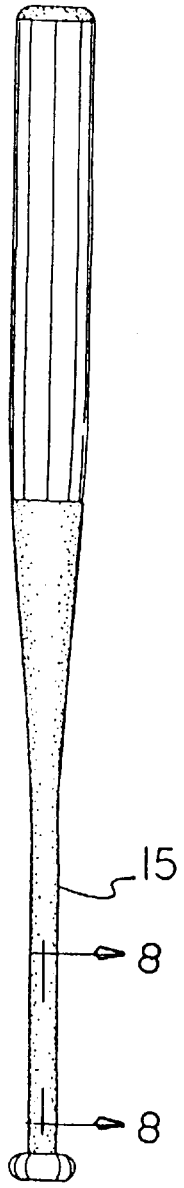
FIGS. 1A and 1B show alternate embodiments of the invention.
Figure 1B:
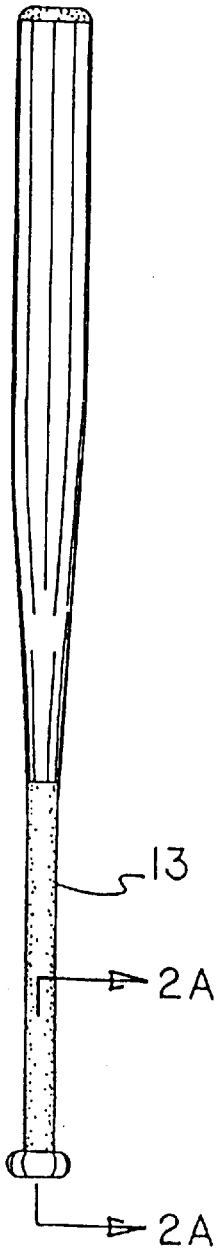
Figure 7:
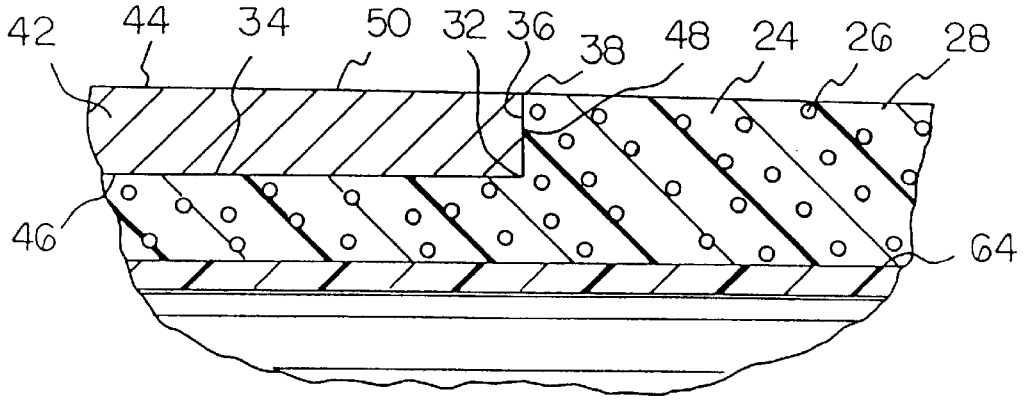
FIG. 7 is a cross-sectional view at the intersection of the hitting area and the recess taken along line 7—7 of FIG. 1A.
Figure 8:
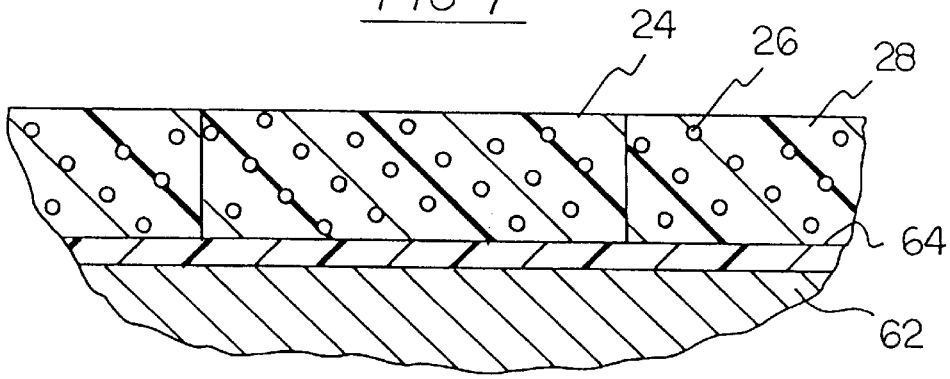
FIG. 8 is a cross-sectional view of the bat taken in the handle area where the bat is composed entirely of composite material taken along line 8—8 of FIG. 1A.
Figure 7A:
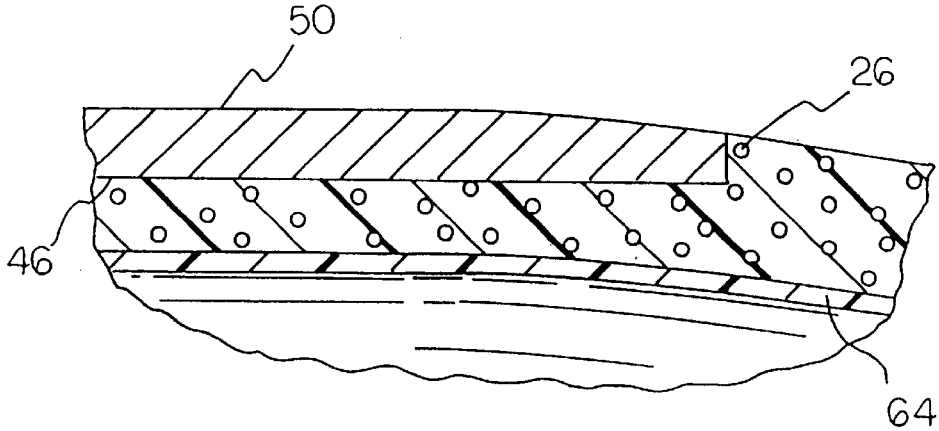
FIG. 7A is a view similar to FIG. 7 but showing a tapered metal barrel.

In the alternate embodiment of FIGS. 1A and 7, the bat 15 has its metal of the hitting area from essentially the remote end of the bat to essentially the beginning of the transition zone. In the embodiment of FIGS. 1B and 7A, the metal of the hitting area tapers and extends essentially to the handle area.

Figure 2A:
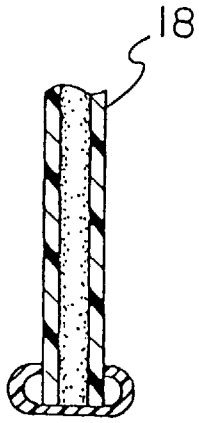
FIG. 2A is a cross-sectional view of the handle area of the FIG. 1B embodiment taken along line 2A—2A of FIG. 1B.

A further alternate embodiment is shown in FIG. 2A. In such embodiment, the knob is separately formed. Such knob is then attached as by an adhesive to the end of the bat in the handle area. In contrast to this, the knob of the primary embodiment is formed during the fabrication of the bat frame.

Figure 9:
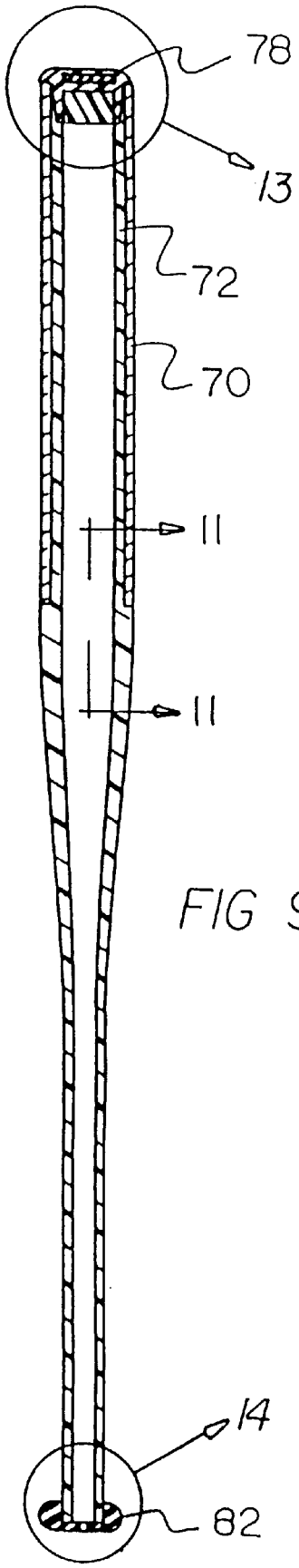
FIG. 9 is a cross-sectional view similar to FIG. 2 but showing an alternate embodiment of the invention.

Further embodiments of the present invention are illustrated in FIGS. 9 through 15. FIG. 9 illustrates the bat frame having an open upper end. The open upper end has a rubber end cap 78 secured therein. The end cap has a circular outer portion and a cylindrical inner portion. The cylindrical inner portion is dimensioned to be received within the open upper end of the bat frame. The rubber end cap is formed of an injection molded material, preferably urethane. The end cap is shown in FIG. 12 as having an inwardly directed projection received within the cylindrical open end of the composite material 72 of the bat and metal barrel 70.

Figure 10:
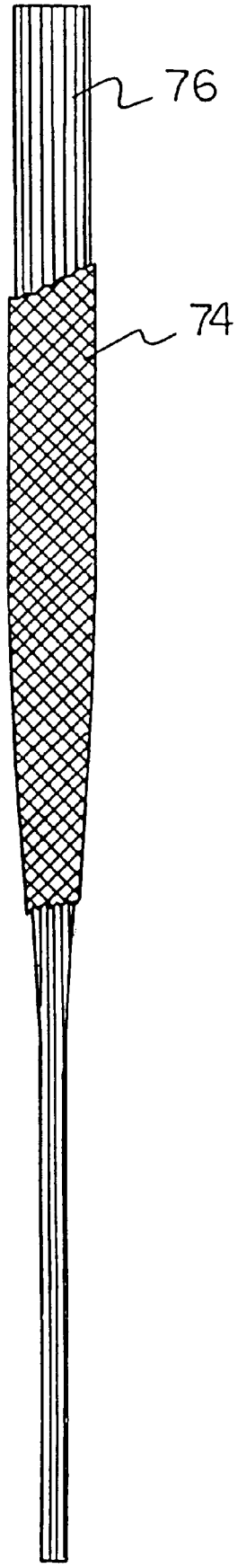
FIG. 10 showing an embodiment with a partial layer of woven fabric, preferably graphite, being applied to the lay-up as the last and exterior ply of the lay-up, this woven ply running the full length of the bat or, in an alternate embodiment, it may extend and be limited to the visible portion of the composite in the finished bat which is mostly the transition area, this ply being used for added impact resistance but principally for cosmetic purposes.
Figure 11:
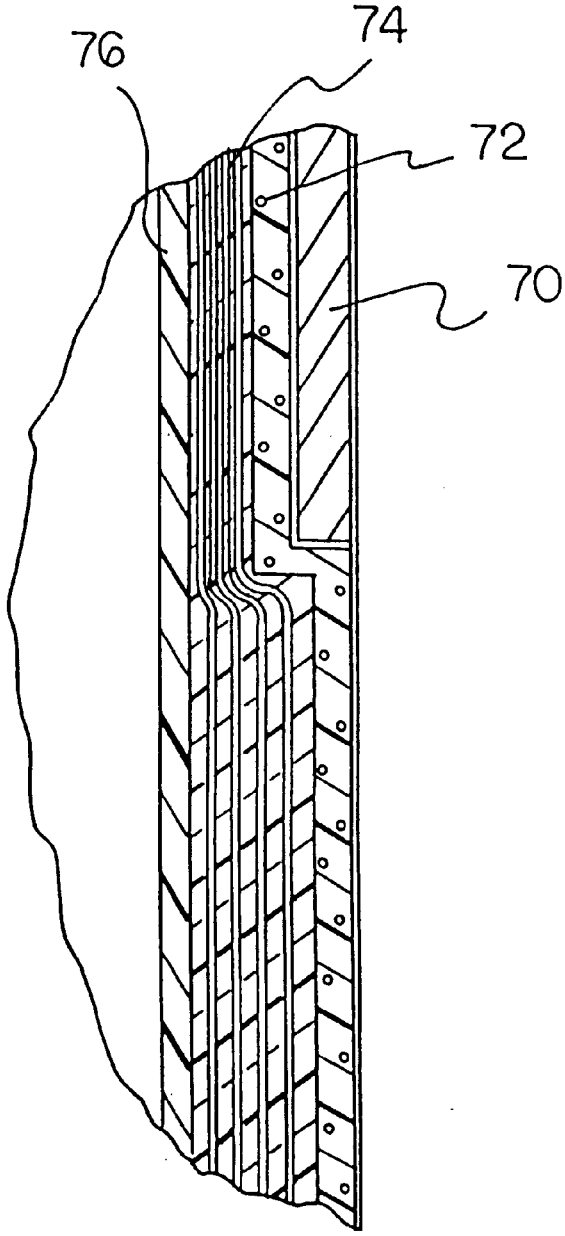
FIG. 11 a cross-sectional view taken along line 11—11 of FIG. 9.

FIGS. 10 and 11 show an alternate embodiment with linear aligned fibers 76 parallel with the axis of the bat at 0 (zero) degrees for added strength and preferably a single layer of braided fibers 70 on the exterior surface principally for enhanced appearance.

FIG. 12 illustrates the weighted metal disc 79 disposed within the rubber end cap 78. The metal disc is formed with a central circular hole 80. The metal disc has a predetermined weight. The preferred predetermined weights are one ounce and three ounce, but other weights could be incorporated.

FIGS. 1B, 2A, 9, 13 and 13A illustrate the handle area having a rubber knob secured thereon. In FIG. 1, the rubber knob is molded onto the end of the handle area. In FIGS. 1B, 2A, 9, 13 and 13A, the knob is formed separately from the bat and may include a hole 84. The handle area of FIG. 13A includes an annular projection positionable in an annular recess in the knob to facilitate the mechanical securement of the rubber knob to the bat. The rubber knob is dimensioned for securement to the bat handle end. The separate rubber knob is preferably fabricated of a molded plastic material. The preferred material is Dow Pellathane, with a shore D of about 30–70.

FIG. 11 illustrate the coatings or finishes for the bat frame on its exterior surface. The coatings are applied via a three step process. The first part involves either painting just the hitting area—the annular metal insert, or the entire bat with a tinted two component urethane base coat. This material can be either sprayed onto the bat or a squeegee coating method can be used. The name of the bat is then applied by either a silk screen or heat transfer decal method. Lastly, a two component urethane coat is applied over the entire length of the bat. The urethane coatings can be either solvent or water based.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of fabricating a ball bat comprising the steps of:

providing a hollow bat frame in a generally cylindrical configuration having an essentially cylindrical enlarged area and having a handle area remote from the enlarged area and with a tapering transition zone intermediate the enlarged area and the handle area, the bat frame being fabricated of a composite material of fibers in a matrix binder and with an internal surface and an external surface;

providing a hollow annular sleeve, the sleeve being fabricated of metal with an interior cylindrical surface and with radially extending parallel end faces and having a cylindrical exterior surface;

positioning the sleeve in contact with the frame in the enlarged area;

positioning the bat frame and sleeve into a mold having an internal configuration corresponding to the exterior configuration of the bat to be fabricated;

applying heat and internal pressure to the bat frame and sleeve, the heat and pressure being sufficient whereby a recess is formed in the enlarged area, the recess being in a cylindrical configuration having an annular face in contact with one surface of the sleeve, the heat and pressure also being sufficient to cure the bat frame; and removing the bat frame and sleeve from the mold to thereby provide a unitary ball bat with a metal sleeve in the enlarged area.

2. The method as set forth in claim 1 wherein the bat frame is formed with an open upper end, the open upper end having a rubber end cap secured therein.

3. The method as set forth in claim 2 wherein the rubber end cap has a weighted metal disc disposed therein, the metal disc having a predetermined weight.

4. The method as set forth in claim 3 wherein the predetermined weight is one ounce.

5. The method as set forth in claim 3 wherein the predetermined weight is three ounces.

6. The method as set forth in claim 3 wherein the handle area has a rubber knob secured thereon.

7. The method as set forth in claim 1 wherein the handle area has a free end, the free end having the rubber knob dimensioned for securement thereto.

8. The method as set forth in claim 1 wherein the bat frame and the annular metal sleeve both are provided with a protective coating disposed there over.

9. The method as set forth in claim 6 wherein the annular metal sleeve is provided with a protective coating disposed there over.

10. The method as set forth in claim 8 wherein the protective coating is fabricated of a plastic material.

11. The method as set forth in claim 10 wherein the plastic material is urethane.

12. The method as set forth in claim 8 and further including indicia applied to the protective coating over the annular metal sleeve.

13. The method as set forth in claim 12 and further including providing a second protective coating disposed over the bat frame.

* * * * *